US009661905B2

(12) United States Patent
O'Donnell et al.

(10) Patent No.: US 9,661,905 B2
(45) Date of Patent: May 30, 2017

(54) MOTORIZED LUGGAGE

(71) Applicants: Kevin O'Donnell, Chicago, IL (US); Boyd Bruner, Chicago, IL (US)

(72) Inventors: Kevin O'Donnell, Chicago, IL (US); Boyd Bruner, Chicago, IL (US)

( * ) Notice: Subject to any disclaimer, the term of this patent is extended or adjusted under 35 U.S.C. 154(b) by 0 days.

(21) Appl. No.: 15/059,015

(22) Filed: Mar. 2, 2016

(65) Prior Publication Data

US 2016/0255928 A1 Sep. 8, 2016

Related U.S. Application Data

(60) Provisional application No. 62/126,915, filed on Mar. 2, 2015.

(51) Int. Cl.

| | |
|---|---|
| ***B62B 1/00*** | (2006.01) |
| ***A45C 9/00*** | (2006.01) |
| ***A45C 5/03*** | (2006.01) |
| ***A45C 5/14*** | (2006.01) |
| ***A45C 13/04*** | (2006.01) |

(52) U.S. Cl.

CPC ..... *A45C 9/00* (2013.01); *A45C 5/03* (2013.01); *A45C 5/14* (2013.01); *A45C 13/04* (2013.01); *A45C 2009/005* (2013.01)

(58) Field of Classification Search

CPC .... A45C 5/14; A45C 8/03; A45C 9/00; A45C 13/04

See application file for complete search history.

(56) References Cited

U.S. PATENT DOCUMENTS

| | | | | |
|---|---|---|---|---|
| 3,316,993 A * | 5/1967 | Weitzner | ..... | A45C 5/14 180/208 |
| 4,913,252 A | 4/1990 | Bartley et al. | | |
| 5,097,922 A * | 3/1992 | Stagi | ..... | B62K 15/006 180/208 |
| 5,207,440 A | 5/1993 | Liang et al. | | |
| 5,645,146 A | 7/1997 | Bieber et al. | | |
| 6,298,964 B1 | 10/2001 | Sadow | | |

(Continued)

OTHER PUBLICATIONS

International Search Report for Application No. PCT/US2016/20498, Applicant Kevin O'Donnell, May 19, 2016.

(Continued)

*Primary Examiner* — John Walters
*Assistant Examiner* — James Triggs
(74) *Attorney, Agent, or Firm* — Richards Patent Law P.C.

(57) ABSTRACT

Motorized luggage includes a frame enclosed in part by an outer shell, the frame defining an internal storage compartment, front wheels connected to a steering shaft, wherein the steering shaft is rotatably connected to the frame and the position of the steering shaft controls an orientation of the front wheels, a retractable handlebar received by the steering shaft, wherein the retractable handlebar may be telescopingly moved from a stored configuration to a driving configuration, wherein in the stored configuration the handlebar is retracted and enclosed by a second zippered flap of the outer shell, wherein in the driving configuration, the handlebar is extended above a top face of the frame, a rear set of wheels connected by a second axle, wherein the second axle is operatively coupled to the frame, and an electric motor mounted on the frame, wherein the electric motor drives the rear wheels.

11 Claims, 6 Drawing Sheets

(56) References Cited

U.S. PATENT DOCUMENTS

| | | | |
|---|---|---|---|
| 7,762,363 | B1 | 7/2010 | Hirschfeld |
| 2006/0048532 | A1 | 3/2006 | Beal |
| 2015/0034402 | A1 | 2/2015 | Dourado |

OTHER PUBLICATIONS

Written Opinion of the International Searching Authority for Application No. PCT/US2016/20498, Applicant Kevin O'Donnell, May 19, 2016.

* cited by examiner

MOTORIZED LUGGAGE

CROSS-REFERENCE TO RELATED APPLICATIONS

This application incorporates by reference and claims the benefit of priority to U.S. Provisional Patent Application No. 62/126,915 filed Mar. 2, 2015.

BACKGROUND OF THE INVENTION

The present subject matter relates generally to motorized luggage. More specifically, the present invention relates to luggage including motorized wheels and steering to permit a user to ride a luggage bag to the user's destination.

Transporting luggage for travel, work, and pleasure is an increasingly common activity in modern life. However, many people, such as persons with limited mobility, have trouble transporting their luggage. Also, the need to carry or pull luggage limits the total weight a person can manage, and may result in multiple trips or the need for assistance in transporting luggage. Thus, there is a need for new luggage systems with increased ease-of-transport. Additionally, there is a need for systems that ease the burdens of travel of all kinds, such as charging electrical devices, avoiding misplacing luggage, charging dead car batteries, etc.

Accordingly, there is a need for motorized luggage, as described herein.

BRIEF SUMMARY OF THE INVENTION

To meet the needs described above and others, the present disclosure provides luggage including motorized wheels and steering to permit a user to ride a luggage bag to the user's destination. Additionally, the luggage provided includes features to provide for charging electrical devices, car batteries, finding the luggage if misplaced, etc.

The luggage may be embodied as a four-wheel steerable motorized bag available in different sizes powered by an electric motor with a belt drive, direct drive or chain drive, a throttle control, and brake system that may be used to carry anything a user could pack into a bag or suitcase. Embodiments may incorporate existing styles of wheels and axles, readily available motors, and battery technology to provide commercially viable luggage. The luggage may be provided in front-wheel or rear wheel drive (In a carry-on embodiment, rear wheel drive is preferred). In some embodiments, such as large checked bags, the luggage may include a rear trans-axle two-wheel drive.

By providing luggage that incudes motorized wheels and steering, the present disclosure solves the problem of mobility by allowing a person to ride their luggage. The luggage may include retractable steering controls for easy deployment and compact storage. Steering controls may include a High/Low key, a variable throttle to control the speed, and a braking system using a drum, disk, electromagnetic or regenerative type. In an embodiment, the luggage has durable, proven polyurethane wheels. The wheels may be retractable.

Retractable, telescoping steering controls may be provided along with industry standard secondary wheels to allow for the luggage to be used in the same way as traditional luggage and packed easily while the drive system gives the user the ability to turn the bag 90 degrees, deploy the steering controls, and commute long distances at a rate of 3 times faster than walking. Additionally, the luggage may permit the user to transport more items at once, thus permitting heavier luggage than a user may normally carry. This may permit the luggage to act as a portable work/power station for multiple fields of work and recreation. As described below, the luggage may also serve as a power back up in times of emergency or being stranded on the road.

The luggage may include built-in removable batteries, a charger and alternative solar panels to help charge the battery. The luggage may also include a USB connection to permit the user to charge her devices. The luggage may also include a GPS/GSM tracker in communication with a user device to prevent lost luggage. In some embodiments, the luggage may include a TSA-approved lock to keep valuables safe. Mini jumper cables may be provided in the body to permit jump-starting a vehicle in the event that the user returns to her car and it has a dead battery. LED lights are provided in an embodiment in the front and back of the luggage for safe use in low light areas. Additionally, in an embodiment, LED lights are provided in the inside of the luggage to see contents in low light areas.

The motorized luggage may include a frame that defines a storage space for containing the luggage and that defines the vehicular and motorized aspects of the luggage. The wheels may be mounted along one face of the luggage. The wheels may be partially concealed within the body to provide a more attractive profile. The portion of the body opposite of the wheels may be provide a surface adapted for the user to sit upon. Foot rests may be provided to permit the user to support the user's feet to provide a comfortable ride. The outer shell of the luggage may be constructed of a lightweight composite material, or other material, such as aluminum, and be configured to provide extreme water resistance.

The luggage can be made from a variety of materials. For example, the luggage may be built from materials such as aircraft aluminum, carbon fiber, cast aluminum, steel, nylon, poly carbonite, wood, plastics and rubber. Other suitable building materials for the structure include alloy metals. Materials may be chosen to maximize strength and carrying capacity while limiting the total weight of the luggage.

The motorized luggage may be powered by an electric motor. In turn, an onboard battery may power the electric motor. A retractable steering mechanism may provide the user control over the direction of the luggage container. The retractable steering mechanism may include power controls to control the speed of the motorized luggage. The power controls may be a turnable handgrip where turning the grip in one direction increases speed, and turning in the other direction decreases speed, or a thumb control working in the same fashion. Additionally, the retractable steering mechanism may include a brake control that is connected to a brake via a brake cable. In some embodiments, the luggage may include a wheel hub drive with regenerative braking, for example, the wheel hub drive may be provided on the front wheels of the luggage.

The motorized luggage may include a USB charging part to permit the user to charge her electronic devices. Solar panels may be integrated into the exterior of the luggage to permit the user to recharge the luggage battery using available light. LED lights may be provided on the luggage to provide increased visibility for the user and for the benefit of nearby pedestrians. For example, headlights may be provided on the forward face of the luggage, and brake lights may be provided on the rear of the luggage. Additionally, tow strap or hitch mounts may be provided on the luggage to permit attachment of other wheeled luggage to the luggage via a tow strap. It is contemplated that the luggage may tow a generator in another bag to provide a mechanism to supply power to the luggage. A wireless key fob may be provided to permit the turning on and off of the vehicular elements of the luggage.

Additionally, in some embodiments, a wristband cut-off switch may be provided and configured to interoperate with the luggage such that when the wristband cut-off switch is not within range of the luggage, the motor of the luggage is disabled. This may prevent unauthorized persons from riding the luggage. The wristband cut-off switch may be detectable by the luggage via near field wireless communication or detection, such as RFID or Bluetooth communication.

The luggage may additionally include a barometer cut-off switch. The barometer cut-off switch may be configured to disable the motor, for example, by cutting battery power to the motor, when the barometer measures pressures consistent with altitudes consistent with flight. The barometer cut-off switch prevents the luggage from accidentally powering on while stored for flight.

The luggage may additionally include a TSA-compliant lock integrated into the luggage to permit secure storage of the user's valuables. The luggage may also include a built in plug to charge the battery at a wall outlet. In some embodiments, the luggage may additionally include mini jumper cables to use the battery to jump start an automobile.

The luggage may include a GPS/GSM transponder that may be used to locate the luggage. For example, the luggage may periodically transmit it's GPS/GSM location via cellular, Bluetooth, etc., to the user device or a remote tracking server. The user may use an application or access a web page to locate the luggage. The application or web page may display the location of the luggage overlaid on a map. It is contemplated that if the luggage has an altitude sensor, the GPS transponder may be turned off by the altitude sensor when the luggage is onboard a flight. Additionally, the luggage may include an accelerometer to turn off the GPS transponder and other electrical devices when the luggage accelerates at speeds consistent with the luggage being onboard an airplane during flight. For example, the luggage may include a controller that measures the speed, acceleration, altitude, etc., using the GPS/GSM, altitude sensor, accelerometer, etc., in order to disable or enable the electronic aspects of the luggage during flight or to otherwise provide the functionality described herein. Additionally, if the baggage moves out of range of the user, as may be determined by the GPS/GSM difference between the luggage and a user device, or the loss of a wireless signal, such as a Bluetooth connection between the luggage and a user device, the luggage may transmit a signal to the user device providing an out-of-range alert.

In some embodiments, the luggage may be capable of autonomous or semi-autonomous driving. For example, the luggage may include servo operated steering to permit remote controlled driving by the user. The luggage may include one or more cameras to permit a remote user to drive the luggage while seeing and responding to obstacles in a video feed from the luggage. The luggage may communicate with a user device to provide the user remote steering controls such as speed and directional controls. In some embodiments, the luggage may autonomously follow a user by tracking the user's location via a Bluetooth signal from the user's device. The user's location may be tracked by one or more Bluetooth receivers on the luggage that are adapted to determine the position of the user relative to the luggage and maintain a certain distance or relative position. In some embodiments, a drive-by-wire system may be provided by the controller on the luggage to permit a user to remotely drive the luggage to a specified location, as may be determined by GPS/GSM or other positioning mechanism.

As noted, the luggage may include a controller to control the operation of the luggage. The controller may include a CPU, memory, and other computer and electronic components to carry out the functionality described herein. The luggage may include wireless communication devices, such as cellular, WiFi, and Bluetooth communication devices in communication with the controller. The controller may also be in communication with the motor and servo operated steering to control the speed and direction of the luggage. The controller may also be in communication with one or more USB chargers (in a preferred embodiment, two chargers) to provide the ability to permit the attachment of peripherals or to charge user devices. The WiFi communication devices may act as a wireless hotpot to permit nearby users to connect to each other or over the cellular network. The controller may also be connected to a microphone to permit the luggage to detect ambient sounds, and to permit the luggage to respond to voice commands. Voice commands may be provided for each type of functionality described herein. The controller may be in communication with a camera system to permit obstacle avoidance. Similarly, the controller may be in communication with homing or radar system to detect obstacles around the luggage. For example, the luggage may include a forward facing camera and corner mounted radar to assist in autonomous or semi-autonomous driving.

In some embodiments, the luggage may include removable inserts that will change the purpose of the bag for different industries. For example but not limited to: students, photographers, construction, artists, DJs. Inserts may include specialized pockets, item holders, compartments, boxes, etc., that may be used to efficiently store and safely transport user materials. Examples of different types of luggage for specific uses are photo bags, medical bags, travel bags, student bags, security bags, safe bags, and tool bags.

In an embodiment, motorized luggage includes: a frame enclosed in part by an outer shell, the frame defining an internal storage compartment, the internal storage compartment accessible through the outer shell by opening a first zippered flap of the outer shell; front wheels along a bottom of the frame, wherein the front wheels are connected to a first axle, wherein the first axle is connected to a steering shaft, wherein the steering shaft is rotatably connected to the frame and the position of the steering shaft controls an orientation of the front wheels; a retractable handlebar received by the steering shaft, wherein the retractable handlebar may be telescopingly moved from a stored configuration to a driving configuration, wherein in the stored configuration the handlebar is retracted and enclosed by a second zippered flap of the outer shell, wherein in the driving configuration, the handlebar is extended above a top face of the frame; a rear set of wheels connected by a second axle, wherein the second axle is operatively coupled to the frame; and an electric motor mounted on the frame, wherein the electric motor drives the rear wheels.

In some embodiments, the frame further includes a cradle, wherein when the handlebar is in the stored configuration, the handlebar rests in a slot of the cradle, the slot including barriers to restrict the rotation of the handlebar.

In some embodiments, the motorized luggage further includes a retractable pull handle movable between a retracted configuration and an extended configuration, wherein the retractable pull handle extends out from a rear face of the frame when in the extended configuration.

In some embodiments, the motorized luggage furthers including a GPS module that determines a current location, a wireless communication module in communication with a user device, and a controller in communication with the GPS module and the wireless communication module, wherein the controller is configured to receive the current location from the GPS module, and transmit the current location to the user device via the wireless communication module.

In some embodiments, the motorized luggage further includes a barometer in communication with the controller, wherein the controller is configured to engage or disengage control of the electric motor by the throttle, wherein, when the controller detects, via the barometer, a barometric pressure below a predetermined threshold that is consistent with airline flight, the controller disengages control of the electric motor by the throttle.

In some embodiments, the motorized luggage further includes an RFID sensor and an RFID wristband, wherein the wristband is adapted to be worn by a user of the motorized luggage, wherein the controller is configured to engage or disengage control of the electric motor by the throttle, wherein the RFID sensor is in communication with the controller, wherein the controller is configured to routinely scan for the presence of the RFID wristband, wherein, when the controller does not detect the RFID wristband after scanning for the RFID wristband, the controller disengages control of the electric motor by the throttle.

In some embodiments, the bottom face of the frame includes an upper level and a lower level that define a recessed space below the upper level, wherein the front wheels extend downwards from the upper level into the recessed space.

And, in some embodiments, the upper level and the lower of the bottom face of the frame are connected by a transition, wherein the transition includes channels, wherein foots rests are connected to the transition, wherein the foot rests may move from a stowed configuration in the channels, to an extended configuration extending away from the frame. Also, in some embodiments, the electric motor drives the rear wheels via a drive belt. Additionally, in some embodiments, the electric motor is controlled by a throttle mounted on the retractable handlebar.

In some embodiments, the motorized luggage further includes a sensor to detect a force applied to the luggage by a user, wherein the sensor is in communication with the sensor, wherein the controller is configured to control of a speed of the electric motor, wherein in response to detecting, by the sensor, a force applied to the luggage, the controller sets the motor speed to a speed calculated using a magnitude of the measured force.

In some embodiments, the frame extends from a front face to a rear face along a length, wherein the steering shaft is mounted to the frame within the length from the front face to the rear face.

An object of the invention is to create a mode of transport that enables a person to commute at a faster speed while increasing the ease of carrying their luggage.

An advantage of the invention is that it allows users to ride the luggage carrying their belongings instead of carrying their belongings themselves.

An advantage of the invention is that it provides luggage to permit a user to commute at a speed up to three times the speed of walking; to transport more at once, including heavier luggage than what a user can carry.

Another advantage of the invention is that it provides a power back up in times of emergency or being stranded on the road.

A further advantage of the invention is that it provides luggage the may act as a portable work/power station for multiple fields of work and recreation.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1A:
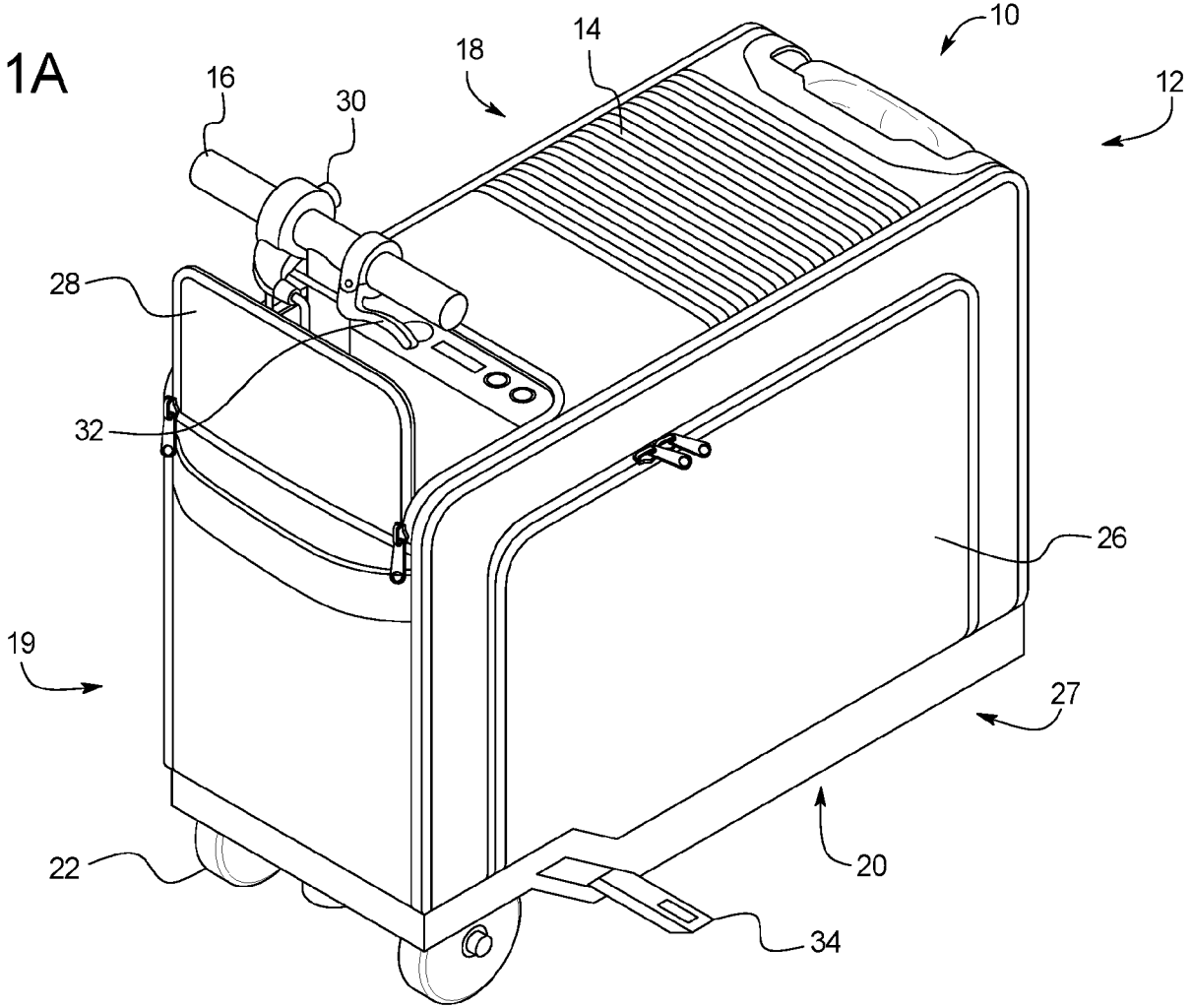
FIG. 1A is a perspective view of an example embodiment of motorized luggage of the present invention in a drive configuration.

FIG. 1A is a perspective view of an example embodiment of motorized luggage 10 of the present invention in a drive configuration 12. A user may operate the motorized luggage 10 to travel to a desired destination along with the luggage 10. The user may sit on a seat 14 and a handlebar 16 may be extended for steering of the luggage 10. In the drive configuration 12, the seat 14 may define the top face 18 of the luggage 10. The bottom face 20 opposite the seat 14 may include wheels; in an embodiment, front wheels 22 are a part of a steering system, and rear wheels 24 are a part of the power system for driving the luggage 10. The luggage 10 may include a storage compartment that may be accessed by opening a flap 26 to store or unload cargo. The storage compartment may be located on a side face 27 of the luggage 10.

In an embodiment, the user steers the luggage 10 using a telescoping handlebar 16. The handlebar 16 may be stowed in a pouch accessible by unzipping a small flap 29. A user may unzip the small flap 29, extend the handlebar 16, and begin driving the luggage 10. The handlebar 16 may include drive components including a throttle 30 and a brake 32. When pressed, the throttle 30 may increase the motor speed and correspondingly increase the speed of the luggage 10. Conversely, the brake 32 may be operated to slow the luggage 10. Like the handlebar of a bike, the user may turn the handlebar 16 to rotate a front axle 23 (FIG. 2) that connects the front wheels 22. In some embodiments, LED lights may be provided on a front face 19 to illuminate the path ahead. LED lights are provided in an embodiment in the inside of the luggage to see contents in low light areas.

Foot rests 34 may be provided on each side of the luggage 10 for comfortable placement of the user's feet. In an embodiment, the foot rests 34 may be stowable, movable between an extended configuration (shown in FIG. 1A) for use during motorized travel, and a stowed configuration (shown in FIG. 1B) when the rests are not in use. For example, in an embodiment shown in FIG. 1B, in the stowed configuration, the foot rests 34 may rest within a channel and may be flush against the outside of the luggage. The foot rests 34 may be mounted on pivots to permit the user to move the foot rests into the extended configuration for use.

Figure 1B:
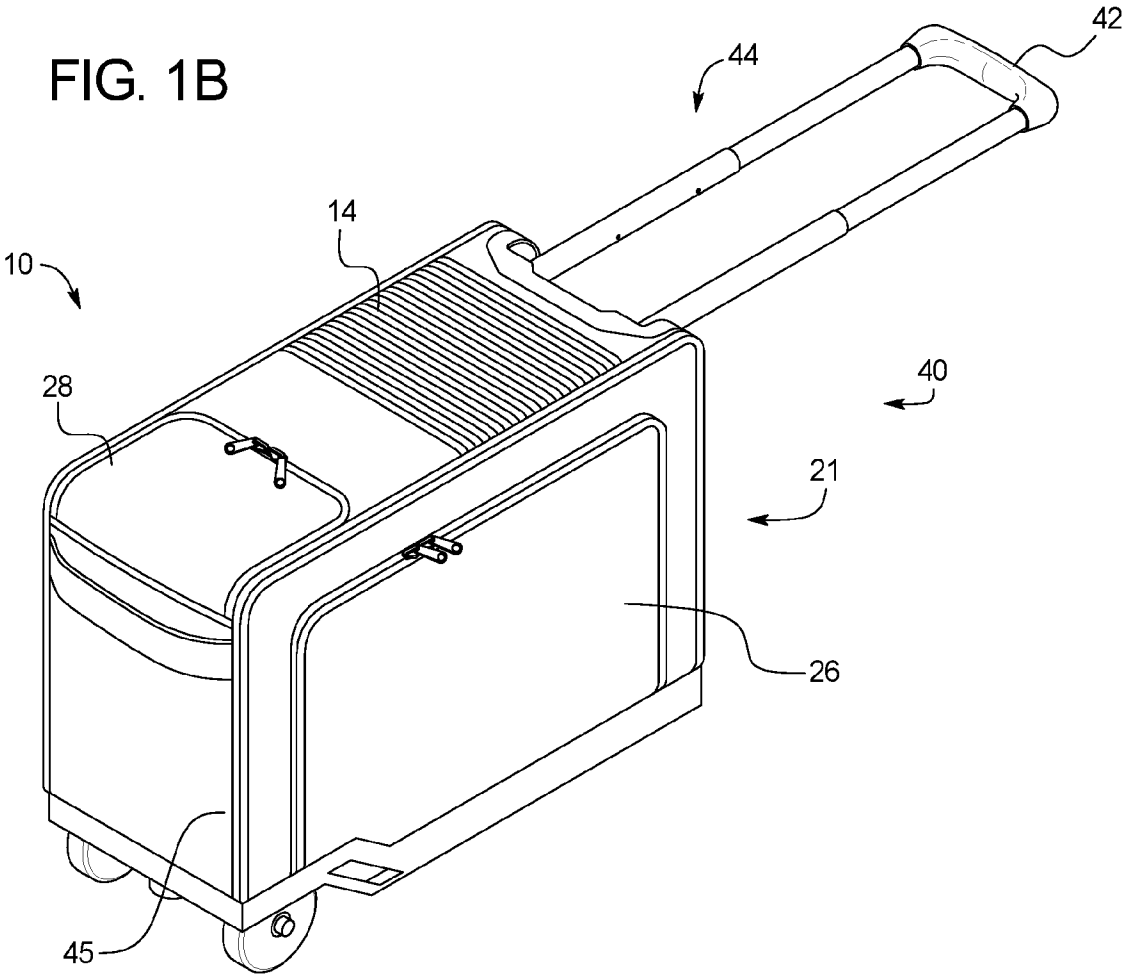
FIG. 1B is a perspective view of the luggage of FIG. 1 in a pull configuration.

As shown in FIG. 1B, the luggage 10 may also be used in a pull configuration 40 to permit the user to pull the luggage 10 by a pull handle 42 as shown in FIG. 1B. As shown, the pull handle 42 may be a part of a telescoping pull handle system 44 on a rear face 21 of the luggage 10. The pull handle 42 may be incorporated into the luggage 10 at an edge opposite of the steering handle near the top face 18 of the luggage 10. When pulled in the pull configuration 40, the luggage 10 may roll on the front wheels 22. The handlebar 16 may be stowed in a cradle 94 (FIG. 3) that prevents the front wheels from rotating as the luggage 10 is pulled in the pull configuration 40.

Figure 4:
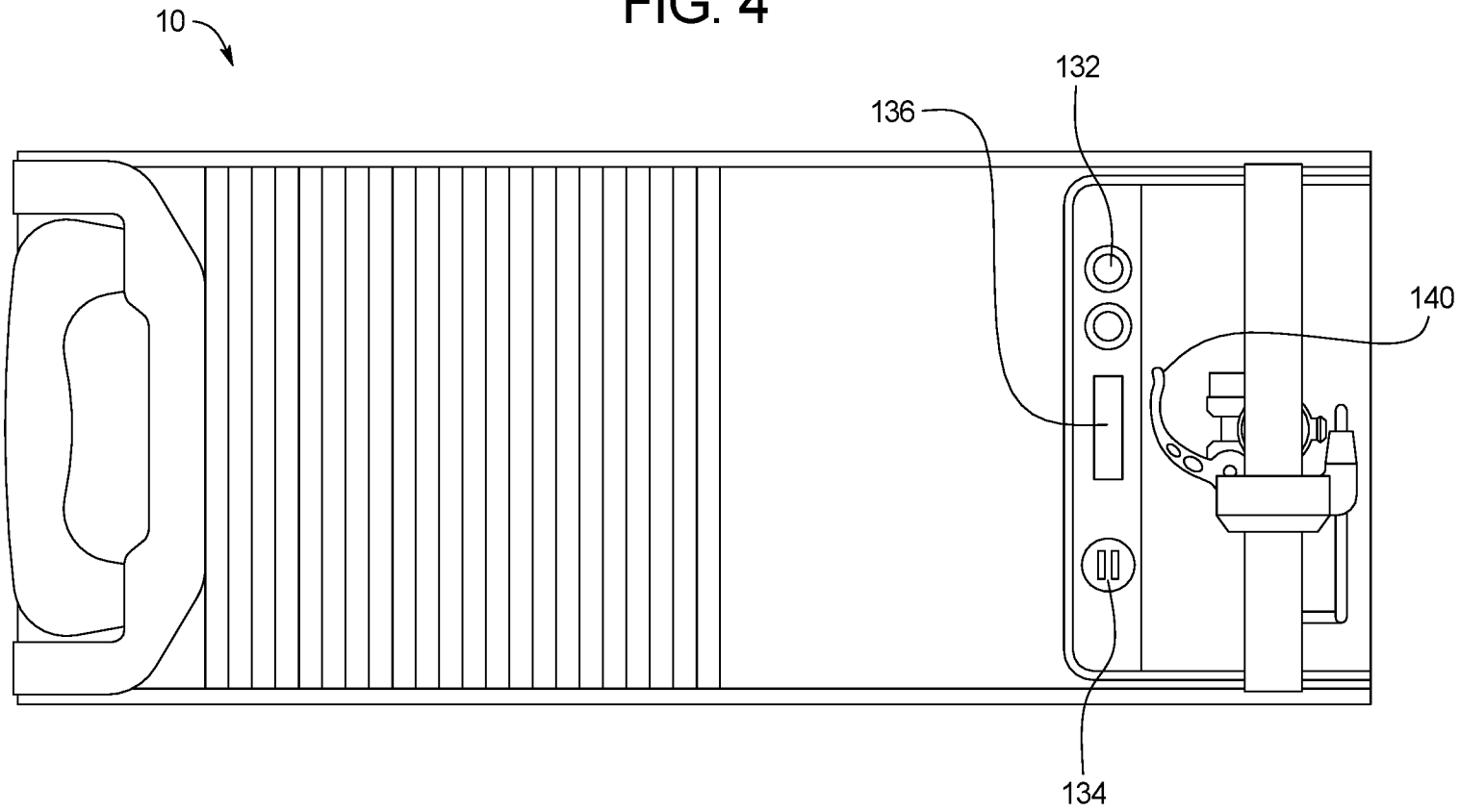
FIG. 4 is a top view of the luggage of FIG. 1.

The luggage 10 may include an exterior fabric shell 45 on its exterior that surrounds internal parts of the luggage 10. The exterior fabric shell 45 may consist of various pieces and include various zipper openings to internal portions of the luggage 10, such as the side flap 28 that provides access to the storage compartment and the small flap 29 that provides access to the handlebar 16 and various other controls on the electronic panel 130 (FIG. 4). The exterior fabric shell 45 may be constructed of a lightweight composite material, or other material, such as aluminum, and be configured to provide extreme water resistance.

Figure 2:
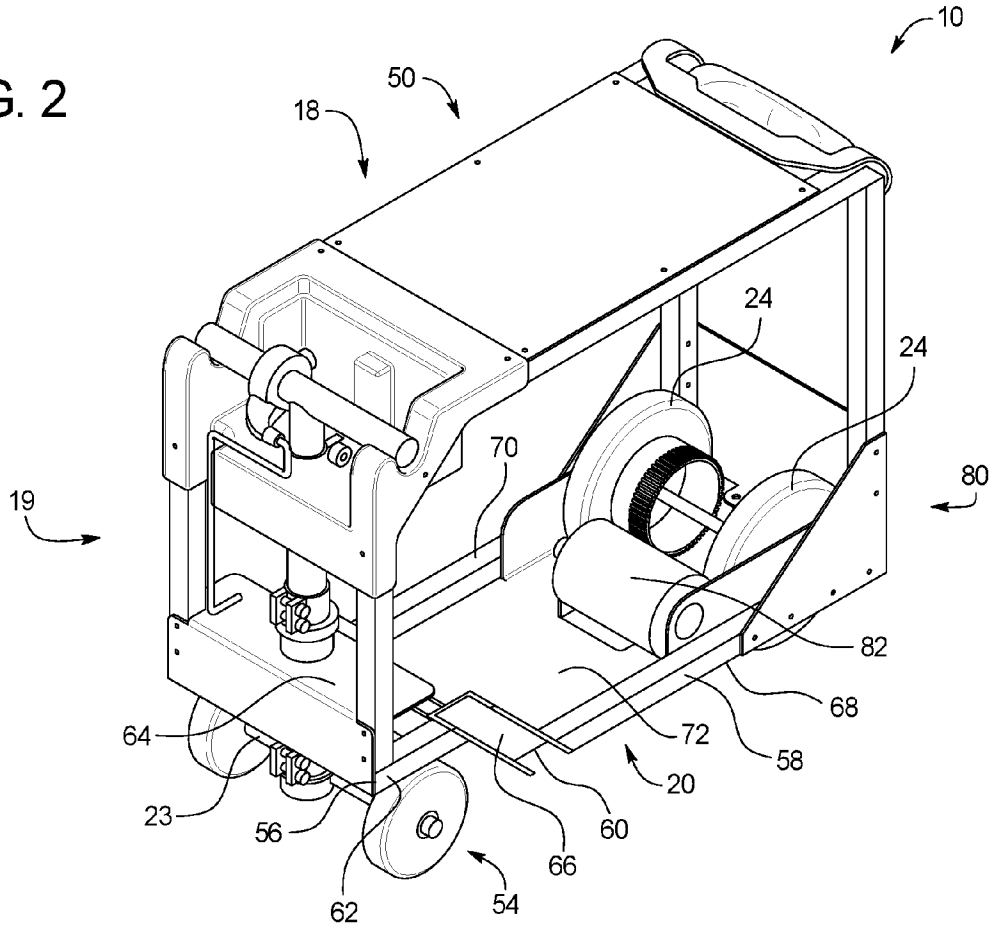
FIG. 2 is a perspective view of the internal parts of the luggage of FIG. 1.

FIG. 2 is a perspective view of the internal parts of the luggage 10. As shown in FIG. 2, the luggage 10 may be defined by a generally box-shaped frame 50 that provides support to the user and defines the internal storage compartment. The luggage 10 may have various faces due to its generally box shaped nature. A steering system 52 may be attached inside the front face 19 of the luggage 10, with the front wheels 22 extending below a bottom face 20, and the handlebar 16 extendable above a top face 18. The steering system 52 may be attached inside the front face 19 of the luggage 10, with the front wheels 22 extending below a bottom face 20, and the handlebar 16 extendable above a top face. The handlebar 16 may be extendable to multiple heights. For example, in an embodiment, the handlebar 16 may extended to a steering level so that a person may drive the luggage 10. Additionally, in an embodiment, the handlebar 16 may be extended to a second extended level higher than the steering level so that a person can walk next to the luggage and use the luggage in a pull fashion or with power assist.

The bottom face 20 of the luggage 10 may include a recessed space 54 for the front wheels 22. The recessed space 54 permits the front wheels 22 to turn freely during steering. To define the recessed space 54, the bottom face 20 may include an upper level 56 and a lower level 58 separated by a transition 60. The upper level 56 may be present above the front wheels 22 and may be defined by upper aluminum tubes 62 on each side face 27 supporting a folded aluminum support 64 for the steering system 52. The upper aluminum tubes 62 may be connected to the transition 60. The transition 60 may include aluminum tubes that are angled relative to the length of the bottom face 20 to connect the upper level 56 to the lower level 58. The transition 60 may include channels 66 defining a space for storage of the foot rests 34 when the luggage 10 is in the pull configuration 40. The lower level 58 of the bottom face 20 may include a left bottom beam 68 and a right bottom beam 70 that are also comprised of aluminum tubes. A floor plate 72 may span the left bottom beam 68 and the right bottom beam 70 to provide support to cargo in the storage compartment and to support the motor 82 and other components of the power system 80.

Figure 3:
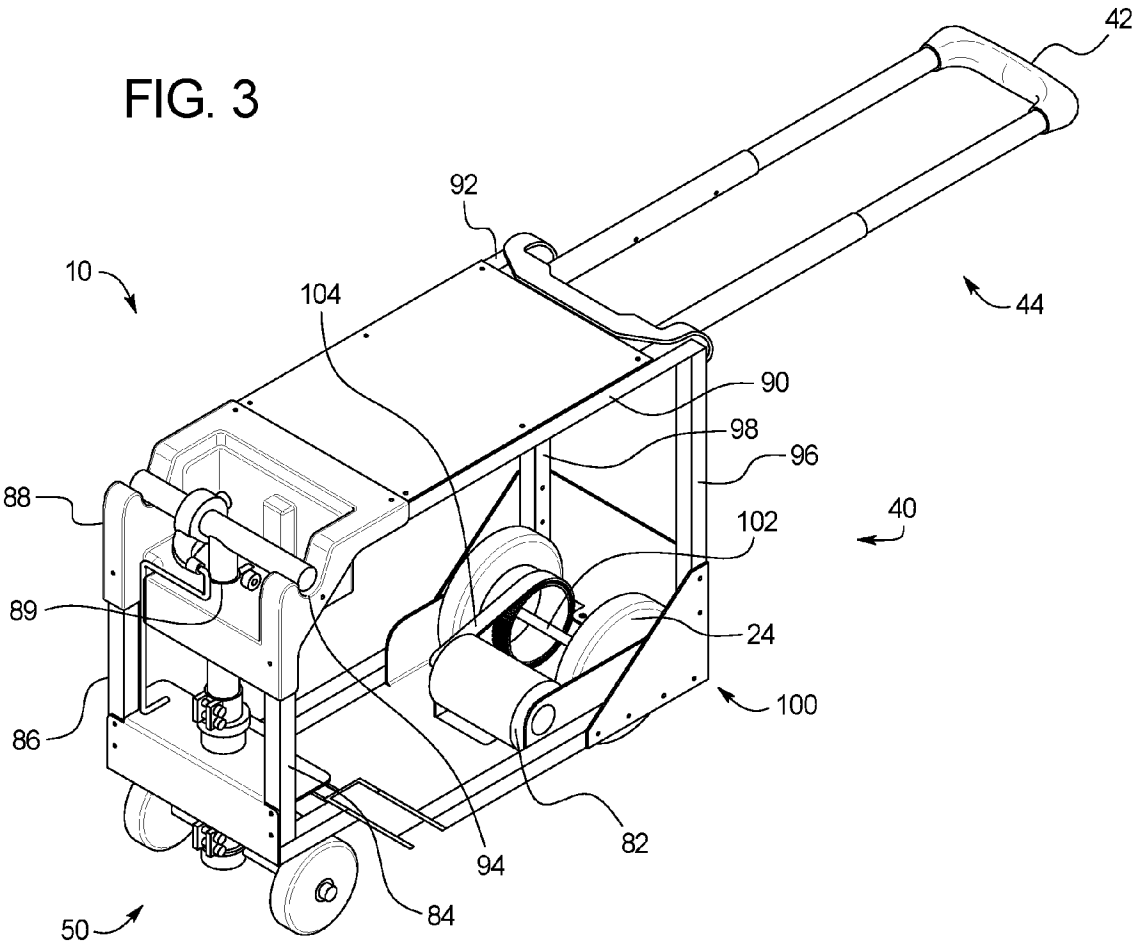
FIG. 3 is a perspective view of the internal parts of the luggage of FIG. 1 in a pull configuration.

FIG. 3 illustrates a perspective view of the internal parts of the luggage 10 with an extended pull handle 42. The pull handle 42 may be a part of a telescoping pull handle system 44 that may be mounted just below the top face 18 of the luggage 10.

The front face 19 of the luggage 10 may be defined by two vertical supports on each edge, a left front frame support 84 and a right front frame support 86 (where "right" and "left" are with respect to a user riding the luggage). The left front frame support 84 and the right front frame support 86 may extend upwards from the upper level 56 to a front edge joint 88. The front edge joint 88 may connect the left front frame support 84 and the right front frame support 86 to a left top beam 90 and a right top beam 92, respectively. The front edge joint 88 may support an electronics panel 130 (FIG. 4) along with an opening 89 through which the handlebar 16 passes into the interior of the luggage 10. The front edge joint 88 may include a cradle 94 where the handlebar 16 may be held in place when the luggage 10 is in a pull configuration 40.

The rear face 21 of the luggage 10 may also be defined by two vertical supports on each edge, a left rear frame support 96 and a right rear frame support 98. The left rear frame support 96 and the right rear frame support 98 may extend up from the left bottom beam 68 and the right bottom beam 70, respectively, and connect to the left top beam 90 and a right top beam 92, respectively.

The luggage 10 may be driven by a power system 100. The power system 100 may include a motor 82 powered by a battery 152. The motor 82 may drive the rear wheel axle 102 via a motor belt 104. In other embodiments, the luggage 10 may use a direct drive or chain drive. Brakes may be attached in proximity to the rear wheels 24 to permit the user to stop the luggage 10. The handlebar 16 may include a brake control that may be used to activate the brakes. Additionally, in other embodiments, the luggage 10 may use a front-wheel drive power system 100.

FIG. 3 is a side view of the luggage 10. As shown in FIG. 3, the steering system 52 may include a one-and-one-eighth inch tube 110 that is perpendicular to the ground and holds a sealed bearing headset assembly. The headset assembly houses sealed bearings to permit a steering shaft connected to the handlebar 16 to move telescopingly from a retracted position to an extended position for steering and a longer extended position so that a person can walk next to the luggage and use the luggage in a pull fashion or with power assist. The headset assembly additionally connects the steering truck to the front wheels 22, and to the telescoping handlebar 16. In other embodiments, the steering system 52 may include a High/Low key, a variable throttle to control the speed, and a braking system using a drum, disk, electromagnetic or regenerative type.

Figure 5:
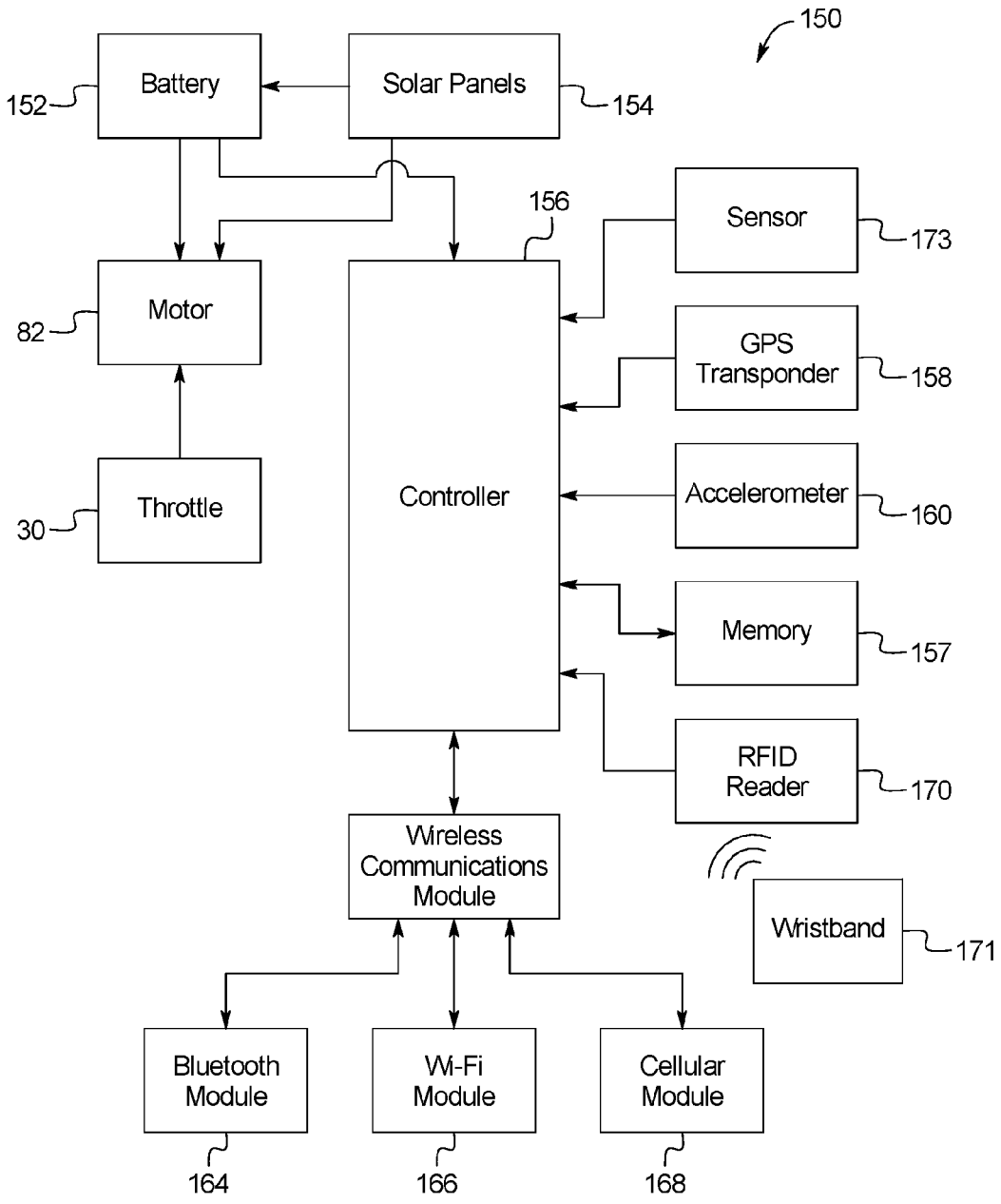
FIG. 5 is a diagram illustrating the electrical components of the luggage of FIG. 1.

In an embodiment, the luggage 10 may include a power assist mode. In embodiment, the power assist mode may be controlled by a controller 156 (FIG. 5). The controller 156 may detect that the user is pulling the luggage 10, for example, by a sensor 173 that measures the rotation of the front wheels 22 or rear wheels 24 not caused by the motor 82, or by a sensor 173 detecting the user applying force to the handlebar 16 (for example, the sensor may be attached to the steering system 52 to measure a torque on the handlebar 16 caused by the user pulling the handlebar in a forward direction). Upon detecting the user pulling the luggage 10, the controller 156 may activate the motor 82 to a speed to match the users pulling force. For example, if the controller 156 detects that the front wheels 22 or rear wheels 24 are turning at a particular speed without power, the controller 156 may activate the motor 82 to that speed. Alternatively, in an embodiment where the controller 156 senses a force applied to the handlebar 16, such as the handlebar being pulled forward, the controller 156 may activate the motor 82 at a speed to minimize that force. In this way, the motor speed may be matched to the user's walking speed.

FIG. 4 is a top view of the luggage 10. As shown in FIG. 4, the front edge joint 88 may include an electronics panel 130 for the user to access various electrical controls and power supplies. In an embodiment, the electronics panel 130 may include a power switch 132 to power on the luggage 10. Additionally, the electronics panel 130 may include USB ports 134 to permit the user to charge her devices as needed. A charge display 136 in the electronics panel 130 may display the current level of charge of the battery 152.

FIG. 4 also illustrates the handlebar 16 resting in the cradle 94 as is desired when the luggage 10 is in the pull configuration. When the user extends the handlebar 16 to begin driving, the user may first unlock the handlebar 16 by dis-engaging a clamp 140. The handlebar 16 may then be extended by pulling the handlebar 16 upwards until it is extended to the drive position. The user may then re-engage the clamp 140 to secure the handlebar 16 in the extended drive position. When the user extends the handlebar 16 to begin walking next to the bag, the user may first unlock the handlebar 16 by dis-engaging a clamp 140. The handlebar 16 may then be extended fully to walk next to the luggage and use the luggage in a pull fashion or with power assist by pulling the handlebar 16 upwards until it is fully extended to the drive position. The user may then re-engage the clamp 140 to secure the handlebar 16 in the extended drive position.

FIG. 5 is a diagram illustrating the electrical components 150 of the luggage 10 including selected connections between them. A battery 152 or solar panels 154 may power the motor 82 and a controller 156 of the luggage 10. When there is sufficient ambient light, the solar panels 154 may charge the battery 152. The throttle 30 may be in electrical connection with and control the speed of the motor 82.

The controller 156 may be provided to perform the computational functions of the luggage 10 described herein. The controller 156 may be in communication with a memory 157 that may include instructions that may be executed by the controller 156 to carry out its functions. The controller 156 may be in communication with and routine poll a GPS/GSM transponder 158 and an accelerometer 160 to determine the luggage's location and motion. The controller 158 may communicate with external computer systems or a user device via a wireless communications module 162. The wireless communications module 162 may include various communication sub-modules, such as a Bluetooth communications module 164, a Wi-Fi communications module 166, and a cellular communications module 168. An RFID reader 170 may additionally be in communication with the controller 158 in some embodiments to permit the luggage 10 to locate itself using RFID technology. The controller 156, the memory 157, the wireless communications module 162, and any other computer circuitry and sensors may be contained within the electronics panel 130. The controller 156 may be in communication with and routine poll a GPS/GSM transponder 158 and an accelerometer 160 to determine the luggage's location and motion. When the luggage 10 is within the boundaries of an airport, the controller 156 may limit the maximum speed of the luggage 10 to a predetermined speed for safety.

Additionally, in some embodiments, a wristband cut-off switch 171 may be a wristband provided to the user with the luggage 10 and configured to interoperate with the luggage 10 such that when the wristband cut-off switch 171 is not within range of the luggage 10, the motor 82 of the luggage 10 is disabled. This may prevent unauthorized persons from riding the luggage 10. The wristband cut-off switch 171 may be detectable by the luggage 10 via near field wireless communication or detection, such as RFID or Bluetooth communication using the Bluetooth communications module 164.

The luggage may additionally include a barometer 172. The controller 156 may be configured to disable the motor 82, for example, by cutting battery power to the motor 82, when the barometer 172 measures pressures consistent with altitudes consistent with flight. The barometer 172 prevents the luggage from accidentally powering on while stored for flight.

The luggage 10 may include the GPS/GSM transponder 158 to permit the user to locate the luggage 10. For example, the luggage 10 may periodically transmit it's GPS/GSM location via cellular, Bluetooth, etc., to the user device or a remote tracking server. The user may use an application on his or her mobile device or access a web page of the remote tracking server to locate the luggage. The application or web page may display the location of the luggage 10 overlaid on a map. It is contemplated that if the luggage 10 has a barometer 172, the GPS/GSM transponder 158 may be turned off by the controller 156 when the luggage 10 is onboard a flight. Additionally, the luggage 10 may include the accelerometer 160 to turn off the GPS/GSM transponder 158 and other electrical devices when the luggage 10 accelerates at speeds consistent with the luggage being onboard an airplane during flight. For example, the controller 156 may measure the speed, acceleration, altitude, etc., of the luggage 10 using the GPS/GSM transponder 158, barometer 172, accelerometer 160, etc., in order to disable or enable the electronic aspects of the luggage 10 during flight or to otherwise provide the functionality described herein. Additionally, if the luggage 10 moves out of range of the user, as may be determined by the GPS/GSM difference between the luggage 10 and a user device, or the loss of a wireless signal, such as a Bluetooth connection between the luggage 10 and a user device, the luggage 10 may transmit a signal to the user device providing an out-of-range alert.

In some embodiments, the luggage 10 may be capable of autonomous or semi-autonomous driving. For example, the luggage 10 may include servo operated steering to permit remote controlled driving by the user. The luggage 10 may include one or more cameras to permit a remote user to drive the luggage 10 while seeing and responding to obstacles in a video feed from the luggage 10. The luggage 10 may communicate with a user device to provide the user remote steering controls such as speed and directional controls. In some embodiments, the luggage 10 may autonomously follow a user by tracking the user's location via a Bluetooth signal from the user's device. The user's location may be tracked by one or more Bluetooth module 164 on the luggage that are adapted to determine the position of the user relative to the luggage and maintain a certain distance or relative position. In some embodiments, a drive-by-wire system may be provided by the controller 156 to permit a user to remotely drive the luggage 10 to a specified location, as may be determined by GPS or other positioning mechanism.

The controller 156 may also be connected to a microphone to permit the luggage 10 to detect ambient sounds, and to permit the luggage 10 to respond to voice commands. Voice commands may be provided for each type of functionality described herein. The controller 156 may be in communication with a camera system to permit obstacle avoidance. Similarly, the controller 156 may be in communication with homing or radar system to detect obstacles around the luggage 10. For example, the luggage 10 may include a forward facing camera and corner mounted radar to assist in autonomous or semi-autonomous driving.

The front wheels 22 and the rear wheels 24 may be constructed from polyurethane. The outer shell of the luggage, including the left front frame support 84, right front frame support 86, left top beam 90, right top beam 92, left rear frame support 96, right rear frame support 98, etc., may be constructed of a lightweight composite material, or other material, such as aluminum, and be configured to provide extreme water resistance.

The luggage 10 may include a memory 157, controllers 156, such as one or more data processors, image processors and/or central processors, and a peripherals interface. The memory 157, and the one or more controllers 156 can be separate components or can be integrated in one or more integrated circuits. The various components in the luggage 10 can be coupled by one or more communication buses or signal lines, as will be recognized by those skilled in the art.

Communication functions can be facilitated through a wireless communications module 162, which can include radio frequency receivers and transmitters and/or optical (e.g., infrared) receivers and transmitters. The specific design and implementation of the wireless communications module 162 can depend on the communication network(s) over which the luggage 10 is intended to operate. For example, the luggage 10 can include communication subsystems designed to operate over a GSM network, a GPRS network, an EDGE network, a Wi-Fi or Imax network, and a Bluetooth network. In particular, the wireless communication subsystems may include hosting protocols such that the luggage 10 may be configured as a base station for other wireless devices.

The memory 157 can include high-speed random access memory and/or non-volatile memory, such as one or more magnetic disk storage devices, one or more optical storage devices, and/or flash memory (e.g., NAND, NOR). The memory 157 may store operating system instructions, such as Darwin, RTXC, LINUX, UNIX, OS X, iOS, ANDROID, BLACKBERRY OS, BLACKBERRY 10, WINDOWS, or an embedded operating system such as VxWorks. The operating system instructions may include instructions for handling basic system services and for performing hardware dependent tasks. In some implementations, the operating system instructions can be a kernel (e.g., UNIX kernel).

The memory 157 may also store communication instructions to facilitate communicating with one or more additional devices, one or more computers and/or one or more servers. The memory 157 may include graphical user interface instructions to facilitate graphic user interface processing; sensor processing instructions to facilitate sensor-related processing and functions; phone instructions to facilitate phone-related processes and functions; electronic messaging instructions to facilitate electronic-messaging related processes and functions; web browsing instructions to facilitate web browsing-related processes and functions; media processing instructions to facilitate media processing-related processes and functions; GPS/Navigation instructions to facilitate GPS and navigation-related processes and instructions; camera instructions to facilitate camera-related processes and functions; and/or other software instructions to facilitate other processes and functions (e.g., access control management functions, etc.). The memory 157 may also store other software instructions controlling other processes and functions of the luggage 10 as will be recognized by those skilled in the art. An activation record and International Mobile Equipment Identity (IMEI) or similar hardware identifier can also be stored in memory 157.

Each of the above identified instructions and applications can correspond to a set of instructions for performing one or more functions described herein. These instructions need not be implemented as separate software programs, procedures, or modules. The memory 157 can include additional instructions or fewer instructions. Furthermore, various functions of the luggage 10 may be implemented in hardware and/or in software, including in one or more signal processing and/or application specific integrated circuits. Accordingly, the luggage 10, may be adapted to perform any combination of the functionality described herein.

Aspects of the systems and methods described herein are controlled by one or more controllers 156. The one or more controllers 103 may be adapted run a variety of application programs, access and store data, including accessing and storing data in associated databases, and enable one or more interactions via the luggage 10. Typically, the one or more controllers 156 are implemented by one or more programmable data processing devices. The hardware elements, operating systems, and programming languages of such devices are conventional in nature, and it is presumed that those skilled in the art are adequately familiar therewith.

For example, the one or more controllers 156 may be a PC based implementation of a central control processing system utilizing a central processing unit (CPU), memories and an interconnect bus. The CPU may contain a single microprocessor, or it may contain a plurality of microcontrollers 156 for configuring the CPU as a multi-processor system. The memories include a main memory, such as a dynamic random access memory (DRAM) and cache, as well as a read only memory, such as a PROM, EPROM, FLASH-EPROM, or the like. The system may also include any form of volatile or non-volatile memory. In operation, the main memory is non-transitory and stores at least portions of instructions for execution by the CPU and data for processing in accord with the executed instructions.

The one or more controllers 156 may further include appropriate input/output ports for interconnection with one or more output displays (e.g., monitors, printers, touchscreen, motion-sensing input device, etc.) and one or more input mechanisms (e.g., keyboard, mouse, voice, touch, bioelectric devices, magnetic reader, RFID reader, barcode reader, touchscreen, motion-sensing input device, etc.) serving as one or more user interfaces for the processor. For example, the one or more controllers 156 may include a graphics subsystem to drive the output display. The links of the peripherals to the system may be wired connections or use wireless communications.

Aspects of the systems and methods provided herein encompass hardware and software for controlling the relevant functions. Software may take the form of code or executable instructions for causing a processor or other programmable equipment to perform the relevant steps, where the code or instructions are carried by or otherwise embodied in a medium readable by the processor or other machine. Instructions or code for implementing such operations may be in the form of computer instruction in any form (e.g., source code, object code, interpreted code, etc.) stored in or carried by any tangible readable medium.

As used herein, terms such as computer or machine "readable medium" refer to any medium that participates in providing instructions to a processor for execution. Such a medium may take many forms. Non-volatile storage media include, for example, optical or magnetic disks, such as any of the storage devices in any computer(s) shown in the drawings. Volatile storage media include dynamic memory, such as main memory of such a computer platform. Common forms of computer-readable media therefore include for example: a floppy disk, a flexible disk, hard disk, magnetic tape, any other magnetic medium, a CD-ROM, DVD, any other optical medium, punch cards paper tape, any other physical medium with patterns of holes, a RAM, a PROM and EPROM, a FLASH-EPROM, any other memory chip or cartridge, or any other medium from which a computer can read programming code and/or data. Many of these forms of computer readable media may be involved in carrying one or more sequences of one or more instructions to a processor for execution.

It should be noted that various changes and modifications to the presently preferred embodiments described herein will be apparent to those skilled in the art. Such changes and modifications may be made without departing from the spirit and scope of the present invention and without diminishing its attendant advantages.

The invention claimed is:

1. Motorized luggage comprising:

a frame enclosed in part by an outer shell, the frame defining an internal storage compartment, the internal storage compartment accessible through the outer shell by opening a first zippered flap of the outer shell;

front wheels along a bottom of the frame, wherein the front wheels are connected to a first axle, wherein the first axle is connected to a steering shaft, wherein the steering shaft is rotatably connected to the frame and the position of the steering shaft controls an orientation of the front wheels;

a retractable handlebar received by the steering shaft, wherein the retractable handlebar moves between a stored configuration and a driving configuration, wherein in the stored configuration the handlebar is retracted and enclosed by a second zippered flap of the outer shell, wherein in the driving configuration, the handlebar is extended above a top face of the frame;

a rear set of wheels connected by a second axle, wherein the second axle is operatively coupled to the frame, wherein a transition spans the upper level and the lower of the bottom face of the frame, wherein the transition includes at least two separate channels parallel to one another and located on opposing sides of the frame from each other, wherein at least two foot rests are connected to the transition with at least one foot rest located in each channel, wherein each of the foot rests move between a stowed position in which the foot rest is located more within its respective channel and an extended position in which the foot rest extends away from the frame and is located less within its respective channel; and an electric motor mounted on the frame, wherein the electric motor drives the rear wheels.

2. The motorized luggage of claim 1, wherein the frame further includes a cradle, wherein when the handlebar is in the stored configuration, the handlebar rests in a slot of the cradle, the slot including barriers to restrict the rotation of the handlebar.

3. The motorized luggage of claim 1, further including a retractable pull handle movable between a retracted configuration and an extended configuration, wherein the retractable pull handle extends out from a rear face of the frame when in the extended configuration.

4. The motorized luggage of claim 1, further including a GPS module that determines a current location, a wireless communication module in communication with a user device, and a controller in communication with the GPS module and the wireless communication module, wherein the controller is configured to receive the current location from the GPS module, and transmit the current location to the user device via the wireless communication module.

5. The motorized luggage of claim 1, further including a barometer in communication with the controller, wherein the controller is configured to engage or disengage control of the electric motor by the throttle, wherein, when the controller detects, via the barometer, a barometric pressure below a predetermined threshold that is consistent with airline flight, the controller disengages control of the electric motor by the throttle.

6. The motorized luggage of claim 5, further including an RFID sensor and an RFID wristband, wherein the writstband is adapted to be worn by a user of the motorized luggage, wherein the controller is configured to engage or disengage control of the electric motor by the throttle, wherein the RFID sensor is in communication with the controller, wherein the controller is configured to routinely scan for the presence of the RFID wristband, wherein, when the controller does not detect the RFID wristband after scanning for the RFID wristband, the controller disengages control of the electric motor by the throttle.

7. The motorized luggage of claim 1, wherein the bottom face of the frame includes an upper level and a lower level that define a recessed space below the upper level, wherein the front wheels extend downwards from the upper level into the recessed space.

8. The motorized luggage of claim 1, wherein the electric motor drives the rear wheels via a drive belt.

9. The motorized luggage of claim 1, wherein the electric motor is controlled by a throttle mounted on the retractable handlebar.

10. The motorized luggage of claim 1, further including a sensor to detect a force applied to the luggage by a user, wherein the sensor is in communication with the sensor, wherein the controller is configured to control of a speed of the electric motor, wherein in response to detecting, by the sensor, a force applied to the luggage, the controller sets the motor speed to a speed calculated using a magnitude of the measured force.

11. The motorized luggage of claim 1, wherein the frame extends from a front face to a rear face along a length, wherein the steering shaft is mounted to the frame within the length from the front face to the rear face.

* * * * *